United States Patent [19]

Keshani

[11] Patent Number: 4,863,193

[45] Date of Patent: Sep. 5, 1989

[54] MULTI-YEAR CALENDAR

[76] Inventor: Khosrow Keshani, 5109 Dudley La., #102, Bethesda, Md. 20814

[21] Appl. No.: 212,057

[22] Filed: Jun. 23, 1988

[51] Int. Cl.[4] ..... B42D 5/04; G09D 3/00

[52] U.S. Cl. ..... 283/2; 40/107

[58] Field of Search ..... 283/2, 63 A, 67; 40/107, 109, 121; 402/19; 434/408, 416, 430

[56] References Cited

U.S. PATENT DOCUMENTS

| | | | |
|---|---|---|---|
| 458,970 | 9/1891 | Fitch | 283/2 |
| 462,627 | 11/1891 | Cussons | 52/395 |
| 534,726 | 2/1895 | Stevens | 283/2 |
| 722,020 | 3/1903 | Hoffman | 40/107 |
| 789,166 | 5/1905 | Manfred | 283/2 |
| 1,368,672 | 2/1921 | Wilkinson | 283/2 |
| 1,848,634 | 3/1932 | Kruger | 283/2 |
| 3,838,530 | 10/1974 | Schelling, Jr. | 283/2 |
| 3,964,195 | 6/1976 | Jordan | 283/2 |
| 4,201,405 | 5/1980 | Rannenberg | 283/4 |
| 4,319,771 | 3/1982 | Yglesias | 283/3 |
| 4,472,893 | 9/1984 | Curti | 283/2 |

*Primary Examiner*—Frank T. Yost
*Assistant Examiner*—Paul M. Heyrana, Sr.
*Attorney, Agent, or Firm*—Shlesinger & Myers

[57] ABSTRACT

In accordance with the present invention, a multi-year calendar comprises a plurality of successive sheets, each sheet representing a day of a year. Each sheet includes a first indicia representing the name of a month and a numeric date. Each of the sheets includes first and second rows disposed generally from the left to the right of the sheet. The first row defines first successive regions and the second row defines second successive regions. The first successive regions are in vertical alignment with the second successive regions such that each of the successive regions in the first row is associated with a corresponding region in the second row. Each of the first successive regions include a second indicia representing the number of a year and each of the number increases in consecutive order from the left to the right of the sheet. Each of the second successive regions includes a third indicia representing the day of the week corresponding to the day of the month of the first indicia and to the year of the second indicia in the first row. The third indicia in each corresponding region in the second row in each of the successive sheets progresses consecutively through the days of the week.

10 Claims, 4 Drawing Sheets

MULTI-YEAR CALENDAR

FIELD OF THE INVENTION

The present invention relates generally to calendars and more particularly to a multi-year calendar including a sheaf of pages, one for each day of a year, wherein each page includes indicia representing the day of the week for each year covered by the calendar for the particular day of the year associated with the sheet.

BACKGROUND ART

Current calendars take many different forms, such as a sheaf of 12 sheets, one for each month of a year, a sheaf of 52 sheets, one for each week of a year, or a sheaf of 365 or 366 sheets, one for each day of a normal year and a leap year. One problem all of these calendars have is that they have no facile procedure or structure for transferring days of common interest, such as birthdays, anniversaries, etc. from one year to the next. In consequence, many individuals speed a considerable amount of time at the end of each year to rewrite such dates of common interest on new calendars.

It is, accordingly, an object of the present invention to provide a new and improved multi-year calendar.

Another object of the present invention is to provide a multi-year calendar that facilitates the recording of dates of common interest from year to year.

Another object of the invention is to provide a new and improved multi-year calendar that is easy to use, is inexpensive because it does not require an extensive amount of paper, but still indicates the day of the week for each day of multiple years.

Another object of the invention is to provide a new and improved multi-year calendar wherein the day of the week of common days of the multiple years are indicated on a single sheet.

THE INVENTION

In accordance with the present invention, a multi-year calendar comprises a plurality of successive sheets, each sheet representing a day of a year. Each sheet includes a first indicia representing the name of a month and a numeric date. Each of the sheets includes first and second rows disposed generally from the left to the right of the sheet. The first row defines first successive regions and the second row defines second successive regions. The first successive regions are in vertical alignment with the second successive regions such that each of the successive regions in the first row is associated with a corresponding region in the second row. Each of the first successive regions include a second indicia representing the number of a year and each of the number increases in consecutive order from the left to the right of the sheet. Each of the second successive regions includes a third indicia representing the day of the week corresponding to the day of the month of the first indicia and to the year of the second indicia in the first row. The third indicia in each corresponding region in the second row in each of the successive sheets progresses consecutively through the days of the week.

Because of the aligned relationship of the areas of the first and second rows of successive areas, a user of the calendar is able to determine the day of the week of the particular day for the day associated with each page for every year of the calendar period. In other words, each page for a particular day includes aligned areas containing the year of interest and the day of the week of interest for the day represented by the sheet.

If the years represented by the calendar do not include any leap years, the sheaf of pages includes 365 pages. If, however, the years represented by the calendar include a leap year, the sheaf of sheets includes 366 pages, one for each of the 365 days of a normal year, and one for February 29. The pages representing the days of the year follow consecutively with each other, in the same order as the days of the year. On the page representing February 29 there is a reduced number of entries, one for each leap year in the multi-year calendar. For example, a multi-year calendar for the decade beginning in 1990, includes, on February 29, entries for only 1992 and 1996.

The multiple pages are preferably bound together in book like form so that the calendar sheets do not become frayed with use. Each page preferably includes space to record common days or events of interest for the particular day and space to record appointments and occurrences during each day. A multi-year calendar with such a record of appointments and occurrences is of considerable importance to persons who must make reference to prior appointments, sometimes many years after the fact.

The above and still further objects, features and advantages of the present invention will become apparent upon consideration of the following detailed description of several specific embodiments thereof, especially when taken in conjunction with the accompanying drawings.

DESCRIPTION OF THE PREFERRED EMBODIMENTS

Figure 1:
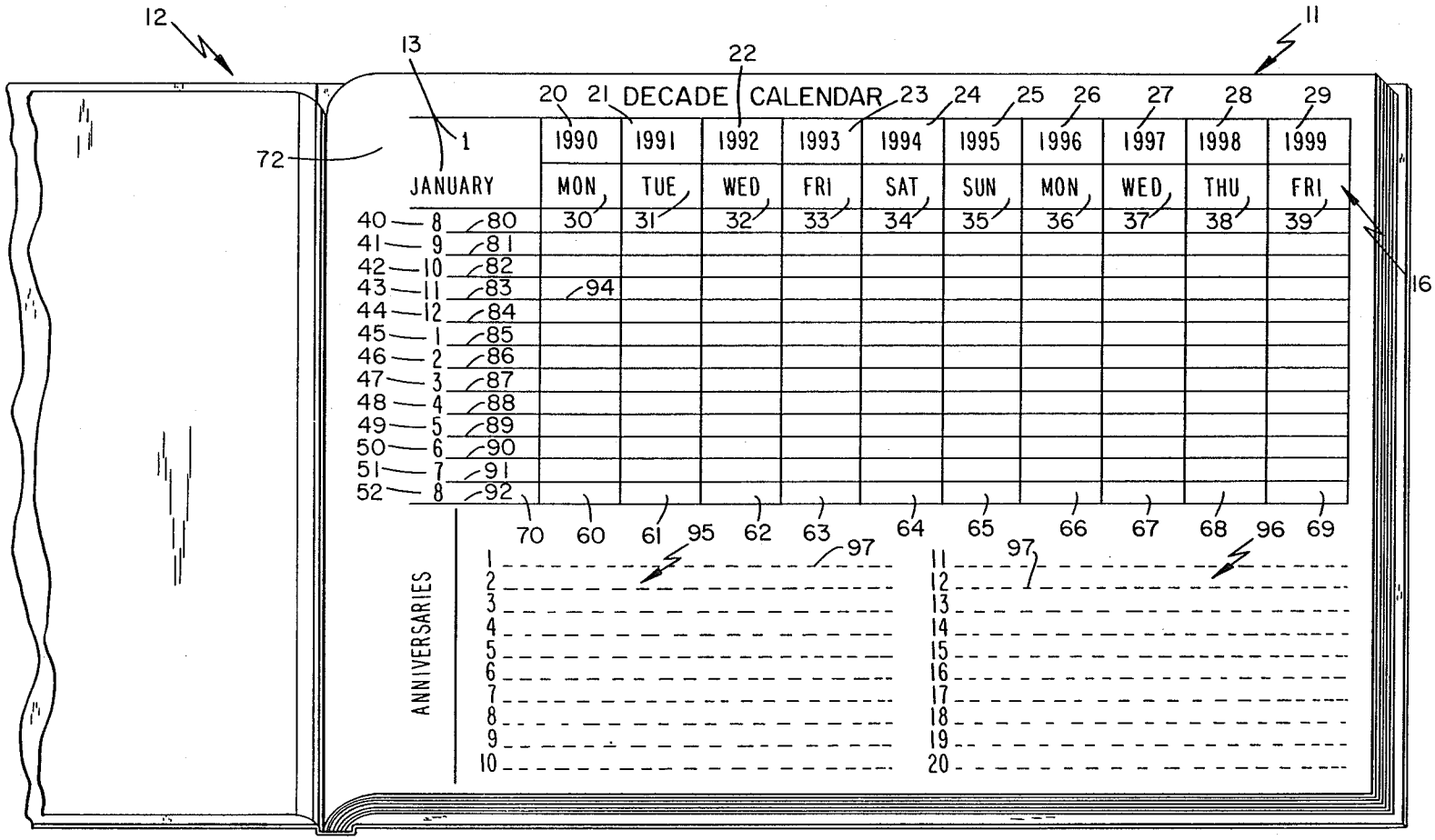
FIG. 1 is a drawing of a bound volume in accordance with the invention wherein the volume is open to the page representing January 1 of a 10 year calendar.
Figure 2:
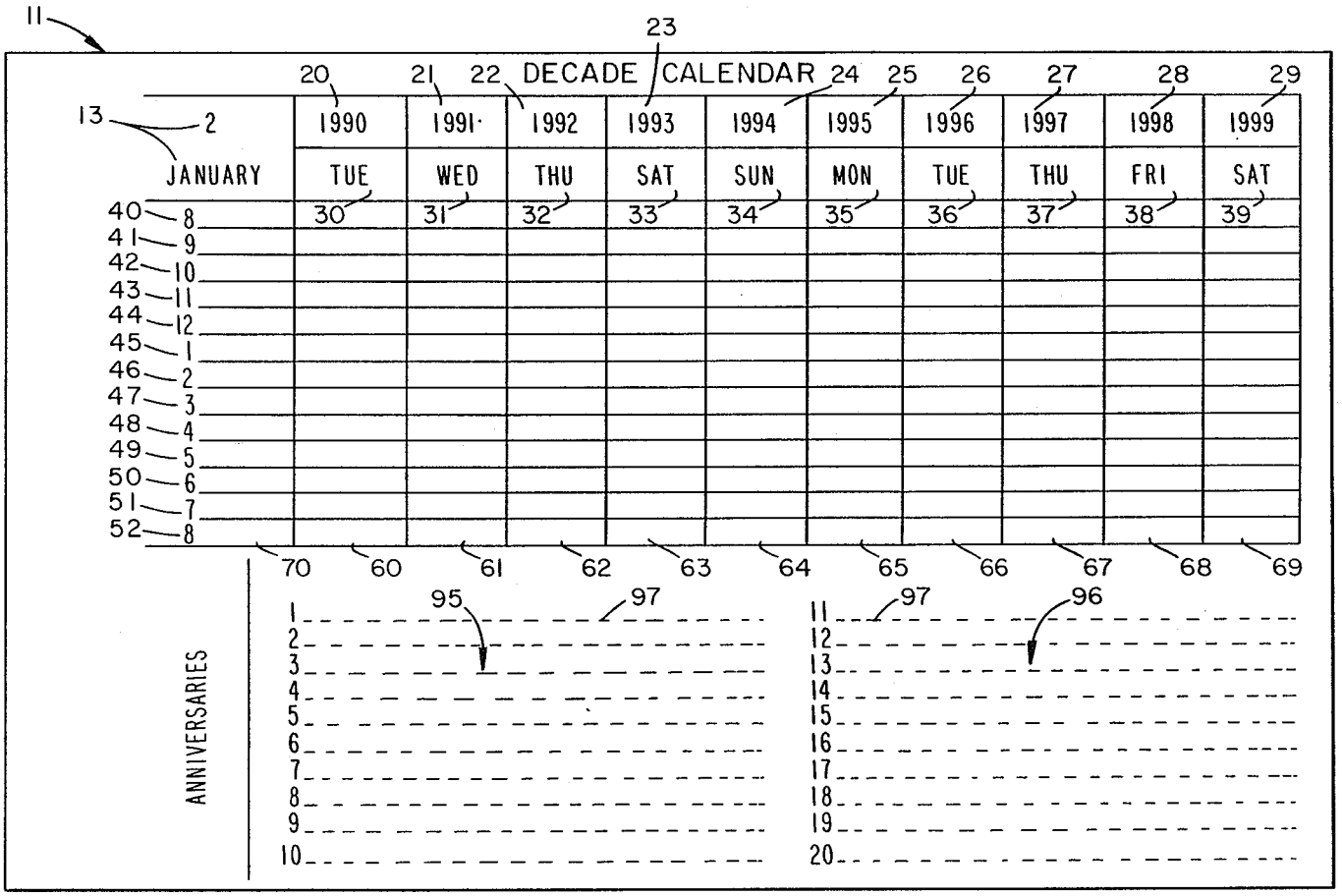
FIG. 2 is a drawing of a page representing January 2 in the volume illustrated in FIG. 1.
Figure 3:
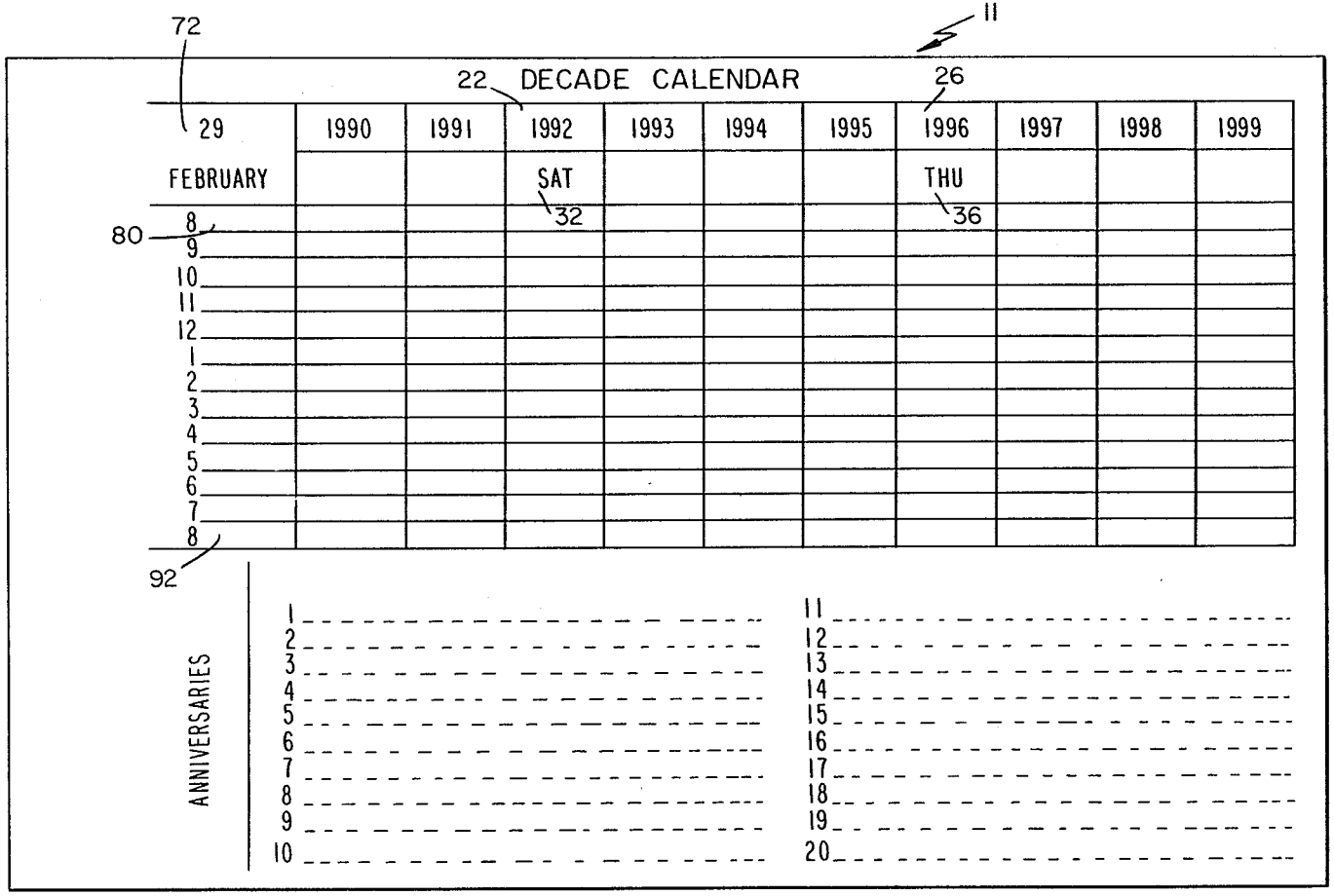
FIG. 3 is a drawing of a page representing February 29 in the volume illustrated in FIG. 1.
Figure 4:
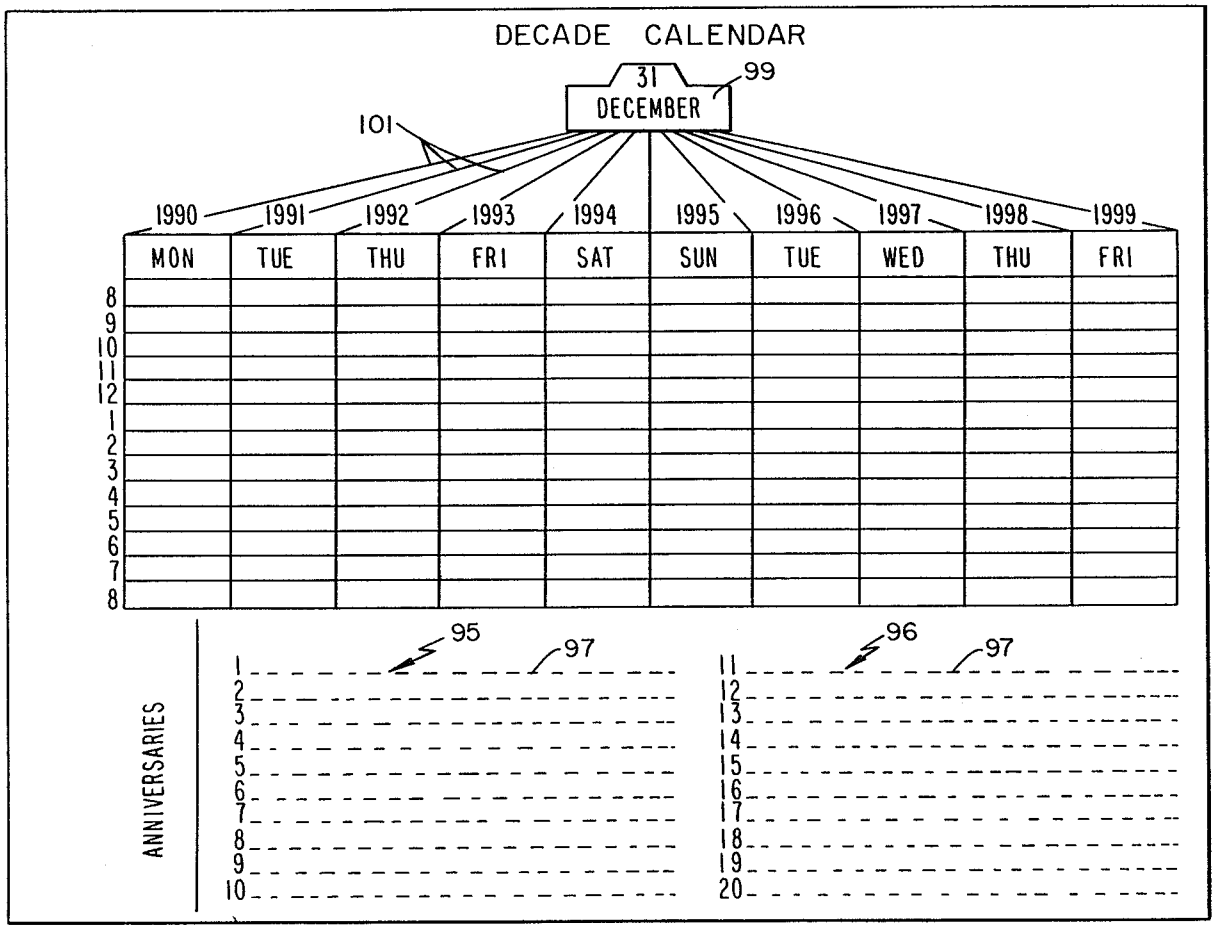
FIG. 4 is a drawing of a page representing December 31 in another embodiment of a 10 year calendar.

Reference is now made to FIG. 1 of the drawing wherein sheaf 11 of 366 paper pages is illustrated as being bound in book 12. Each page in sheaf 11 represents each day in a leap year and includes indicia 13 representing the particular day of the year, in terms of numerical days of each month associated with the particular sheet. In FIG. 1 indicia 13 represent January 1 while indicia 13 in FIGS. 2, 3 and 4 are respectively on pages representing January 2, February 29 and December 31. Consecutive pages in sheaf 11 bear indicia representing consecutive days of a leap year. Thus, the pages illustrated in FIGS. 1 and 4 are respectively the first and last pages of calendar books in accordance with the invention, while the pages of FIGS. 2 and 3, respectively representing January 2 and February 29 are the second and sixtieth pages of calendar book 12.

Pages or sheets 11 in book 12 contain indicia representing the days of the week for the decade beginning Jan. 1, 1990 and ending Dec. 31, 1999. On each of the pages 11 of FIGS. 1, 2 and 4, the years of the decade are represented by indicia in row 15 so that the years 1990, 1991, 1992, 1993, 1994, 1995, 1996, 1997, 1998, and 1999 are represented by indicia associated with these years in regions 20–29 across row 15. Below row 15 is row 16 bearing indicia representing the day of the week in each of the years of row 15 for the particular day of the year represented by indicia 13. Row 16 includes regions 30–39, respectively aligned with regions 20–29. Thus, on the page of FIG. 1, representing January 1 for each day in the decade 1990–1999, indicia Monday, Tuesday, Wednesday, Friday, Saturday, Sunday, Monday, Wednesday, Thursday and Friday respectively appear in regions 30–39. The aligned relationship between the indicia in regions 20–29 and 30–39 of rows 15 and 16, enables the user to determine the day of the week on which January 1 falls for each of years 1990–1999. For example, in 1992, January 1 falls on Wednesday.

The indicia in regions 30–39 for the first 59 pages of book 12, i.e., for January 1 through February 28, progress successively through days of the week, except in years following a leap year. Thus, for the entires of FIG. 1 for January 1, indicia for Friday are in region 33 (corresponding to 1993), while indicia for Wednesday are in region 32 (corresponding to 1992). Similarly, in regions 36 and 37 the indicia are respectively Monday and Wednesday.

For days of the year following the 60th page of sheaf 11, the indicia in row 16 progress differently from the indicia in the first 59 sheets of the sheaf. The days in regions 30–39 progress in sequence for all pages of sheaf 11 following the 60th page except when the year in regions 20–29 has indicia representing a leap year. For example, as illustrated in FIG. 4, the days of the week progress in sequence in the years 1990 and 1991, 1993 through 1995 and 1997–1999. However, in leap years 1992 and 1996, the indicia in regions 32 and 36 skip a day of the week, such that the indicia in regions 31 and 32 of FIG. 4 are respectively Tuesday and Thursday while the indicia in regions 35 and 36 are respectively Sunday and Tuesday. In FIG. 4 the indicia in regions 30 and 31 for the years 1990 and 1991 are respectively Monday and Tuesday, while the indicia in regions 32–35 for the years 1992–1995 are respectively Thursday, Friday, Saturday and Sunday, and the indicia in regions 36–39 for years 1996–1999 are respectively Tuesday, Wednesday, Thursday and Friday. As pointed out supra the sequence has different skips on the pages prior to February 29 for years following a leap year; for example on January 1 and January 2 the skips occur between regions 32 and 33, and between regions 36 and 37.

The 60th page in book 12, representing February 29, (FIG. 3) includes indicia in only the regions of row 16 aligned with regions in row 15 having indicia representing leap years. In the decade calendar of FIG. 3, regions 32 and 36, aligned with regions 22 and 26 representing the leap years 1992 and 1996, respectively bear the legends Saturday and Thursday. The remaining regions 30, 31, 33–35, and 37–39 for the leap year day sheet illustrated in FIG. 3 are blank.

In the embodiment of the invention illustrated in FIGS. 1–3, a matrix containing rows 15 and 16 as well as rows 40–52 and columns 60–70 is provided by sets of intersecting horizontal and vertical lines. Region 72, defined by the intersection of rows 15 and 16 with column 70, includes date indicia 13. The indicia in regions 80–92, defined by the intersection of column 70 with rows of 40–52, contain indicia for hours of the day. The remaining regions 94, defined by the intersections of columns 60–69 and rows 40–52 are blank to provide spaces for a user of the calendar to insert notations for appointments and events which occurred at the time of day for each day in the decade.

Below the matrix including the columns and rows are columns 95 and 96, each including ten rows with lines 97 to provide a region for a user to inscribe recurring dates, such as anniversaries, during the decade. The inscriptions recorded in columns 95 and 96 obviate the need for the calendar user to repeatedly rewrite information from one calendar to another calendar, as each year begins and ends.

The embodiment of FIG. 4 is generally similar to that of FIGS. 1–3, except that indicia 13 for the day of the year is located in region 99 from which radiate lines 101 which form regions 20–29, respectively bearing indicia representing the years 1990–1999. In all other respects, the embodiment of FIG. 4 is the same as the embodiment of FIGS. 1–3 in format.

While there have been described and illustrated several specific embodiments of the invention, it will be clear that variations in the details of the embodiments specifically illustrated and described may be made without departing from the true spirit and scope of the invention as defined in the appended claims.

I claim:

1. A multi-year calendar, comprising:

(a) a plurality of successive sheets;

(b) each of said sheets representing a day of a year;

(c) each of said sheets having top, bottom, left and right sides;

(d) each of said sheets having a first indicia representing the name of a month and a numeric date;

(e) each of said sheets including first and second rows, disposed generally from said left to said right of said sheet;

(f) said first row defining first successive regions and said second row defining second successive regions;

(g) said first successive regions being in vertical alignment with said second successive regions such that each of said successive regions in said first row is associated with a corresponding region in said second row;

(h) each of said first successive regions including a second indicia representing the number of a year;

(i) each of said number of a year being in increasing consecutive order from said left to said right;

(j) each of said second successive regions including a third indicia representing the day of the week corresponding to the day of the month of said first indicia and to the year of said second indicia in said first row; and (k) said third indicia in each corresponding region in said second row in each of said successive sheets progressing consecutively through the days of a week.

2. A multi-year calendar, as in claim 1, wherein:

(a) said plurality of successive sheets includes 365 sheets for each of the day of a non-leap year.

3. A multi-year calendar, as in claim 1, wherein:

(a) said plurality of successive sheets includes 366 sheets for each day of leap year.

4. A multi-year calendar, as in claim 1, wherein:

(a) each of said plurality of successive sheets includes additional rows, disposed below said second row;

(b) each of said additional rows defines successive regions vertically aligned with said second successive regions, thereby forming a plurality of successive columns of regions; and (c) each of said additional rows is associated with a fourth indicia representing the time of say, disposed to the left of said additional rows to enable a user to make notations on a region associated with the hour of the day of the week represented by said third indicia, and the year represented by said second indicia.

5. A multi-year calendar, as in claim 1, wherein:

(a) each of said plurality of successive sheets includes a region below said second row for inscribing recurring dates.

6. A multi-year calendar, as in claim 1, wherein:

(a) said first and second rows each includes ten successive regions for a decade calendar.

7. A multi-year calendar, as in claim 1, wherein:

(a) said plurality of successive sheets are bound in bookform.

8. A multi-year calendar, as in claim 1, wherein:

(a) said first indicia is disposed to the left and said first and second rows.

9. A multi-year calendar, as in claim 1, wherein:

(a) said first indicia is above said first row.

10. A multi-year calendar, as in claim 1, wherein:

(a) said second indicia includes at least a leap year; and (b) said third indicia in each of said regions in said second row progresses consecutively through the days of the week, from said left to said right of each of said sheets, except at or after the leap year where the progression skips a day.

* * * * *